United States Patent [19]

Rumpz

[11] 4,434,578

[45] Mar. 6, 1984

[54] AUTOMATIC TRAFFIC CONTROL GATE

[76] Inventor: Raphael J. Rumpz, 33863 Cornelissen, Sterling Heights, Mich. 48077

[21] Appl. No.: 389,180

[22] Filed: Jun. 17, 1982

[51] Int. Cl.[3] ..... E01F 13/00; E05F 11/24

[52] U.S. Cl. ..... 49/49; 49/334; 49/340; 49/344

[58] Field of Search ..... 49/49, 35, 334, 340, 49/344

[56] References Cited

U.S. PATENT DOCUMENTS

| | | | |
|---|---|---|---|
| 2,362,710 | 11/1944 | Miskelly | 49/334 |
| 2,528,733 | 11/1950 | Brass | 49/334 |
| 3,086,430 | 4/1963 | Emmel | 49/49 X |
| 3,877,174 | 4/1975 | McDonald | 49/334 |

*Primary Examiner*—Philip C. Kannan

*Attorney, Agent, or Firm*—Charles W. Chandler

[57] ABSTRACT

A traffic control arm powered by a motor and a linear actuator connected between the motor and the arm such that as the motor is rotated, a restraining force acting on the arm will not prevent continued rotation of the motor shaft.

2 Claims, 3 Drawing Figures

AUTOMATIC TRAFFIC CONTROL GATE

BACKGROUND OF THE INVENTION

This invention is related to traffic control arms of the type having an arm normally disposed in a horizontal position but raised to an upper position to permit passage of a vehicle, and more particularly to such a traffic control arm in which a linear actuator having a ball screw assembly is connected between the driving motor and the shaft on which the arm is mounted.

Automatic gates typically employ an arm that is disposed in a horizontal position in the path of traffic, such as in parking lots and the like. When the driver of a vehicle takes appropriate action such as depositing a coin in an actuating means, the arm is raised to permit passage of the vehicle.

A conventional traffic control arm employs a motor connected through belt means to a speed reducer which in turn is linked to the shaft on which the control arm is mounted. Such an arrangement has several problems. For example, the drive belts gradually wear out and have to be adjusted. The speed reducer, necessary to reduce the rotational output of the motor, has a tendency to have its gear stripped when unauthorized persons hang onto the arm as it is being raised. The oil in the speed reducer has to be routinely checked for a proper level.

SUMMARY OF THE INVENTION

The broad purpose of the present invention is to provide an improved automatic traffic control arm which employs a ball screw linear actuator between the motor and the arm. Such an arrangement provides several advantages over conventional commercial traffic control arms. For example, it does not require the same maintenance as the conventional commercial system. A shorter linkage between the actuator and the arm is permitted thereby reducing the costs of operation and the wear. A smaller motor can be employed because it is connected to a lever attached to the shaft with no other linkage. The preferred system requires less weight, is more compact, more efficient and is less costly than other systems.

Still further objects and advantages of the invention will become readily apparent to those skilled in the art to which the invention pertains upon reference to the following detailed description.

DESCRIPTION OF THE DRAWING

The description refers to the accompanying drawings in which like reference characters refer to like parts throughout the several views and in which.

DESCRIPTION OF THE PREFERRED EMBODIMENT

Figure 1:
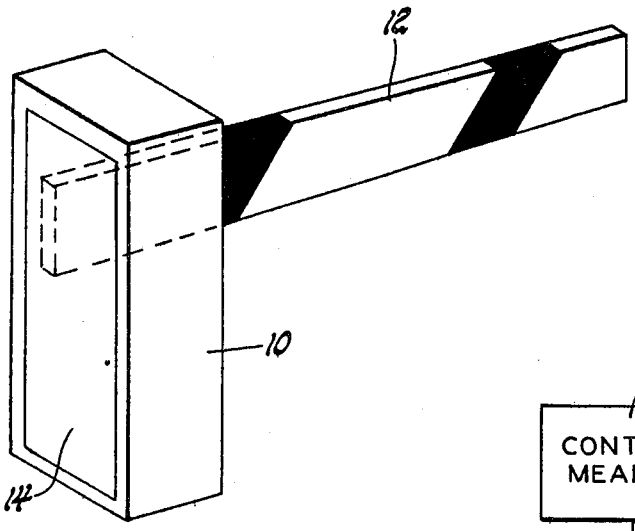
FIG. 1 is a perspective view of a traffic control arm illustrating the preferred embodiment of the invention.

Referring to the drawings, a preferred automatic traffic control gate is illustrated as comprising support means 10. Arm 12 has one end connected to the support means such that the opposite end can be raised from a lower horizontal position to a raised position in the manner well known to those skilled in the art.

Figure 2:
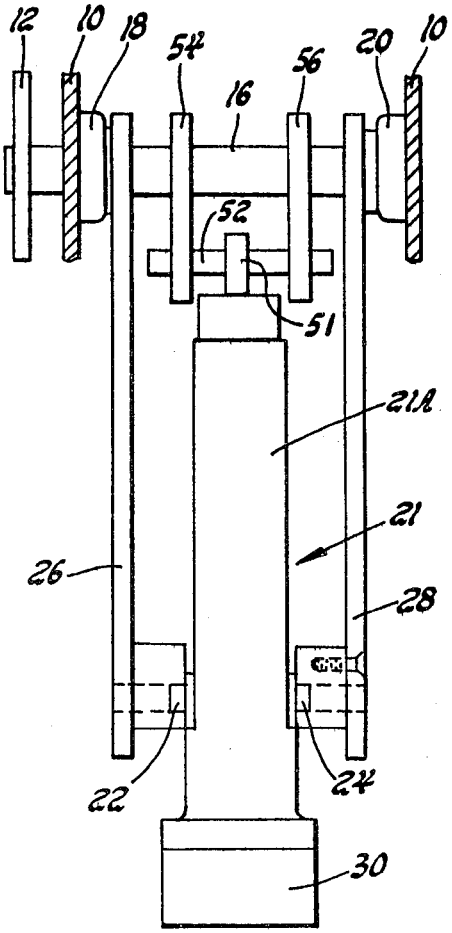
FIG. 2 is an elevational view of the linear actuator.
Figure 3:
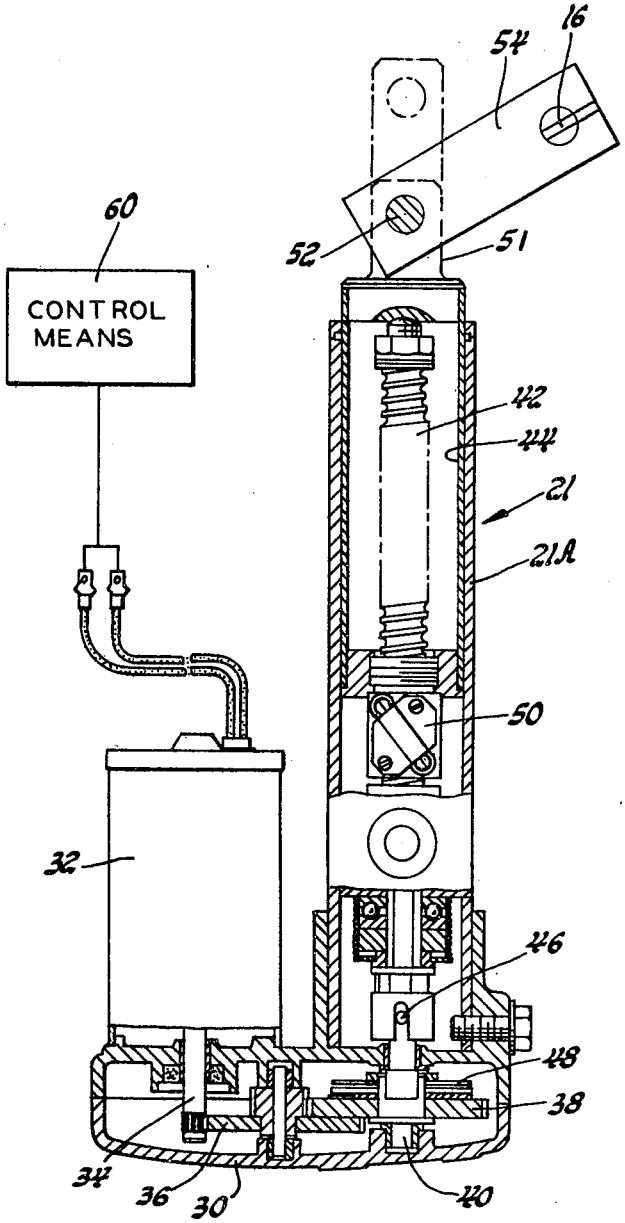
FIG. 3 is a sectional view of the actuator showing the ball screw assembly.

Referring to FIG. 2, support means 10 includes a housing having a removable door 14, permitting access to the interior of the housing. A horizontal shaft 16 has its ends supported in bearing means 18 and 20 in the support housing.

Linear actuator means, generally indicated at 21, are mounted in the support housing for raising and lowering arm 12. Linear actuator means 21 comprises an outer tube 21A having a pair of trunnion means 22 and 24 journaled in a pair of hangers 26 and 28 which have their upper ends connected to shaft 16.

Gear housing means 30 are connected to the lower end of the outer tube. Motor means 32 are mounted on the gear housing means. Motor means 32 has a rotatable output member 34 meshed with gear means 36. A gear member 38 is connected to the gear means and mounted on a pin means 40.

A screw member 42 is mounted in an inner tube 44 which is telescopically slideably mounted in outer tube 21A. The lower end of the screw member is connected by coupling 46 to pin means 40. Slip clutch means 48 connect coupling 46 to gear member 38.

Ball nut means 50 are mounted on the screw and connected to the inner tube in such a manner that as the screw is rotated by the motor, the nut moves axially to either extend the inner tube out of the outer tube, or to move it in the opposite direction to move the inner tube into the outer tube.

The arrangement is such that as the motor is energized, it rotates coupling 46, however, should a force restraining the rotation of the coupling be imposed on the inner tube, the motor can continue to rotate.

The inner tube carries an eye 51. A short shaft 52 is connected by a pair of short levers 54 and 56, pinned to shaft 16, in such a manner that as the inner tube is extended from the outer tube, the levers rotate shaft 16 to raise arm 12. As the inner tube is retracted into the outer tube, the levers pivot in the opposite direction thereby lowering arm 12.

Preferrably motor 32 has a 1/10 horsepower rating at 110 VAC. It can also be a 12 volt DC motor using low voltage as a safety factor to avoid delivering a severe electrical shock to the user. The actuator has permanently sealed lubricated bearings to reduce required maintenance.

Control means 60 are connected to motor 32 to energize it when the arm is to be raised or lowered.

It is to be understood that the slip clutch means permit the motor to rotate even though a restraining force should be imposed on the arm preventing it from either raising or lowering, without damaging the internal components of the actuator. The mechanism is arranged to permit the arm to be mounted so that it can be raised from a lower position on either side of the support housing.

Having described my invention, I claim:

1. An automatic traffic control gate, comprising:
   support means;
   a shaft rotatably mounted on the support means;
   an arm carried on the shaft so as to be movable therewith as the shaft is being rotated from a generally horizontal, lower position toward a raised position;
   power means mounted in the support means, the power means having a rotatable output member;
   an outer tube mounted on the support means;

an inner tube telescopically, slideably mounted in the outer tube;

a pair of trunnions mounted on opposite sides of one of said tubes, and a pair of elongated hangers having their ends connected to the shaft and their lower ends journaling the trunnions;

lever means connecting one of said tubes to the shaft such that as the inner tube and the outer tube are moved in a relatively slideable motion in a first direction, the shaft is rotated in a first direction to raise the arm, and as the inner tube and the outer tube are moved in a relative motion in the opposite direction, the shaft is rotated in the opposite direction to lower the arm;

an elongated screw disposed in said inner tube;

a ball nut mounted in the inner tube and connected to the screw to longitudinally move the inner tube with respect to the outer tube in either said first direction or said second direction depending upon the direction the screw is being rotated; and slip clutch means connected between the power means and the screw to rotate it along its longitudinal axis but to permit the power means output member to rotate with respect to the screw whereby the output member is rotatable independently of the motion of said shaft.

2. A combination as defined in claim 1, in which the arm is so connected to the shaft that it can be positioned so as to be raised from a horizontal to a raised position from opposite sides of the support means.

* * * * *